United States Patent [19]

Hickman

[11] Patent Number: 4,963,882

[45] Date of Patent: Oct. 16, 1990

[54] PRINTING OF PIXEL LOCATIONS BY AN INK JET PRINTER USING MULTIPLE NOZZLES FOR EACH PIXEL OR PIXEL ROW

[75] Inventor: Mark S. Hickman, Escondido, Calif.

[73] Assignee: Hewlett-Packard Company, Palo Alto, Calif.

[21] Appl. No.: 290,543

[22] Filed: Dec. 27, 1988

[51] Int. Cl.[5] ..... B41J 2/01; B41J 2/05

[52] U.S. Cl. ..... 346/1.1; 346/140 R

[58] Field of Search ..... 346/1.1, 140; 358/75, 358/80

[56] References Cited

U.S. PATENT DOCUMENTS

| | | | |
|---|---|---|---|
| 4,528,576 | 7/1985 | Koumura | 346/140 |
| 4,631,543 | 12/1986 | Milbrandt | 346/140 X |
| 4,672,432 | 6/1987 | Sakurada | 346/140 X |
| 4,746,935 | 5/1988 | Allen | 346/140 |
| 4,748,453 | 5/1988 | Lin et al. | 346/1.1 |

FOREIGN PATENT DOCUMENTS

| | | |
|---|---|---|
| 113217 | 9/1979 | Japan . |
| 211458 | 12/1983 | Japan . |
| 104333 | 6/1985 | Japan . |

*Primary Examiner*—Joseph W. Hartary

[57] ABSTRACT

An ink jet printer (60) prints dots (30) of colorant at pixel locations using a printing strategy that reduces the visual impact of improperly operating or inoperable nozzles (18), by using multiple nozzles (18) per pixel location or per pixel row. In one approach, used either for single color or multicolor images, multiple droplets of colorant of the same color are deposited upon a single pixel location from two different nozzles (18). In another approach, used primarily for multicolor images, different pixels of a single pixel row are printed using droplets of a single color from different nozzles (18).

16 Claims, 4 Drawing Sheets

OK-CORRECT COLOR
D-DISTORTED COLOR
X-UNCOLORED PIXEL

PRINTING OF PIXEL LOCATIONS BY AN INK JET PRINTER USING MULTIPLE NOZZLES FOR EACH PIXEL OR PIXEL ROW

BACKGROUND OF THE INVENTION

This invention relates to formation of images on printing media, and, more particularly, to the operation of ink jet printers.

Printers are devices that print images onto a printing medium such as a sheet of paper. Printers of many types are available, and are commonly linked to a computer that defines and supplies the images, in the form of text or figures, that are to be printed. Some printers use a colorant-containing liquid, which may be an ink or a dye, but is often generically termed an ink in the industry, to form the characters on the printing medium. (By contrast, other printers use a dry toner to form the image.) Such printers deliver the colorant to the medium using a print head that creates the proper patterning of colorant to record the image.

One important type of printer is the ink jet printer, which forms small droplets of colorant that are ejected toward the printing medium in the pattern that forms the images. Ink jet printers are fast, producing a high output of print, and quiet, because there is no mechanical impact during formation of the image other than the droplets depositing upon the printing medium. Typically, an ink jet printer has a large number of individual colorant-ejection nozzles in a print head, oriented in a facing, but spaced-apart, relationship to the printing medium. The print head traverses past the surface of the medium, with the nozzles ejecting droplets of colorant under command at the proper times. The droplets strike the medium and then dry to form "dots" that, when viewed together, create the permanently printed image.

Good print quality is one of the most important considerations and bases of competition in the ink jet printer industry. Since the image is formed of thousands of individual dots, the quality of the image is ultimately dependent upon the quality and accurate placement of each dot, and the mode of arranging the dots on the medium. Because of the fashion in which the printing occurs, the quality of the dots can have a surprisingly large effect upon the final image quality, both for black-and-white and color images. The present invention is directed toward improvement of the image by improvements in the quality and placement of the printed dots.

From the practical standpoint of providing a printer that has a long, trouble-free life, the improvement of image quality has two aspects. One is attaining good image quality when using a new print head, and the other relates to maintaining image quality over extended use of the print head. Even though it may be possible to obtain good image quality with the initial use of the print head, the droplet size and/or placement accuracy may degrade with use due to mechanical, electrical, or hydraulic problems that develop, resulting in a degradation in image quality. Both considerations are important in designing print heads and nozzle structures.

Thus, there is a continuing need for improved ink jet printers wherein the dots forming the images are properly placed and of uniform size, and wherein the method of formation of the dots is resistant to degradation with extended use of the print head. The present invention fulfills this need, and further provides related advantages.

SUMMARY OF THE INVENTION

The present invention provides a process for printing dots on a printing medium that ensures a good quality image initially, and also reduces the effect on print quality of failures of individual nozzles during use of the print head. The process can be used with existing print head and nozzle designs, requiring only a change in the mode of operation and not the hardware.

The invention encompasses different strategies for using a double dotting approach to improve print quality both for new print heads and for print heads that have been used and may have blocked or partially inoperative nozzles. In one strategy, each dot is formed from at least two droplets of each color, from different nozzles. The quality of the dots is improved, and the degradation of image quality resulting from a failed nozzle is reduced. In another strategy, dots that require the same colors in a single pixel row are formed using droplets from different nozzles, so that the degradation in image quality due to a failed nozzle is significantly reduced.

In accordance with one aspect of the invention, a process for depositing two dots of a single colorant onto a printing medium at a single selected pixel location comprises the steps of furnishing two colorant delivery nozzles that each deposit colorant of the same selected color, including a first colorant delivery nozzle and a second colorant delivery nozzle; depositing a first droplet of colorant onto the printing medium at the selected pixel location, from the first colorant delivery nozzle; and depositing a second droplet of colorant of the same color onto the printing medium at the same selected pixel location, from the second colorant delivery nozzle.

The invention is based in the strategy for printing the dots at particular locations on the printing medium. The locations at which dots may be printed, or are to be printed, are termed "pixels". The pixel locations are points on the printing medium that may be chosen by the electronic controller of the printer as locations where droplets of ink are to be deposited to form dots upon drying. The pixels are usually visualized as lying on the nodes of a raster of regularly arranged points in two dimensions. Although the pixels are not physically marked on the printing medium other than by dots upon printing, they form a useful convention because they permit an assessment of the dot and image quality actually printed compared to a hypothetical ideal standard pixel array. Since it is the visual appearance of the image that is most important, the use of the pixel location concept also permits comparisons of different methods of forming images using various dot deposition strategies.

In another aspect of the invention, a process for depositing dots of colorant of a single color onto a printing medium in a selected pattern of pixel locations comprises the steps of furnishing at least two sets of colorant delivery nozzles that all deposit colorant of the same selected color, including a first set of colorant delivery nozzles and a second set of colorant delivery nozzles; depositing a first set of droplets of colorant onto the printing medium in the selected pattern of pixel locations, from the first set of colorant delivery nozzles; and depositing a second set of droplets of colorant of the same color onto the printing medium in the same selected pattern of pixel locations, from the second colorant delivery nozzle.

In the presently preferred approach, the process of the invention is implemented with a carriage-mounted print head having multiple ink-ejection nozzles. More specifically in respect to this preferred embodiment of the invention, a process for depositing dots of colorant onto a printing medium in a selected pattern of pixel locations comprises the steps of furnishing a print head having at least two colorant delivery nozzles for depositing colorant of the same selected color, including a first colorant delivery nozzle and a second colorant delivery nozzle, the print head being mounted on a traversing mechanism that moves the print head parallel to and across the surface of a printing medium; traversing the print head over the printing medium in a first pass; depositing a first set of droplets of colorant onto the printing medium in the selected pattern of pixel locations during the first pass, from the first colorant delivery nozzle; traversing the print head across the printing medium in a second pass; and depositing a second set of droplets of colorant onto the printing medium in the same selected pattern of pixel locations during the second pass, from the second colorant delivery nozzle.

In this approach, the first droplet of ink of the selected color that forms any particular dot is deposited on a first pass of the print head over the printing medium. The droplet so deposited has a period of time to be absorbed into the printing medium and to dry. A second droplet of the same color is then deposited at the same location on a later, typically the next, pass of the print head across the printing medium. The second, overprinted, droplet then is absorbed and dries in the same location.

The first approach under the invention thus forms each dot with at least two droplets of ink of the same color, each droplet being ejected from a different nozzle. Preferably, the droplets are deposited at a pixel location with an interval of time between the depositions, permitting the first droplet to dry or partially dry before the second droplet is deposited. Reduction of print quality due to cockle of the paper and bleeding of the dots is thereby reduced.

This approach of forming each dot with at least two droplets of ink of the same color, but from different nozzles, is to be carefully distinguished from the established procedure for forming printed colors. Most color ink jet printers form shades of colors (secondary colors) by depositing two or more droplets of ink of different primary colors, one over the other, so that the net visual effect is a dot of a secondary color determined by the principles of transmitted or reflected color formation. The present approach forms each dot with at least two droplets of the same color, each droplet being ejected from a different nozzle. Dots of primary colors (or black, in a black-and-white printer) are formed by depositing two or more droplets of the same color at the same location. Dots of secondary colors are formed by overprinting two dots of primary colors, wherein each dot is printed using two or more droplets of each primary color, each droplet being from a different nozzle.

The present approach of forming each dot from at least two droplets of ink of the same color, each ejected from a different nozzle, has important advantages over prior approaches wherein a dot is formed from a single droplet of each color or from two droplets ejected from a single nozzle. When the dot is formed from two or more droplets from different nozzles, the likelihood is reduced that the final dot might exhibit irregularities in shape or size, or be improperly positioned relative to the pixel location, that might result from forming the dot of a single droplet ejected from an irregular or partially clogged nozzle. It is highly unlikely that two or more different nozzles will each produce the same irregularity. The two or more droplets that form the dot thus produce an averaging effect that tends to produce dots of uniform size and coverage of targeted pixels throughout the printed image, an important consideration in achieving a uniformly good quality image. The more droplets used to form each droplet, the more the averaging effect. However, it has been found that in most instances of printing on paper, the preferred number of droplets per dot is two, as the overprinting of more droplets tends to slow the printing speed of the printer and deposits more liquid than the paper can absorb without cockle.

The use of multiple dots of the same color, ejected from different nozzles, also tends to increase the area and coverage of each dot, simultaneously reducing the unprinted area between dots. Although the general intent is to deposit all of the dots of the same color precisely on top of each other, the mechanical limitations on the tolerances of the printers and locations of the nozzles ordinarily cause there to be slight offsets in the droplets that form the dots. This result is actually beneficial in that the fraction of the medium covered with dots is increased, improviding the visual image as perceived by the eye.

The formation of each dot by multiple droplets from different nozzles plays a highly significant role in ensuring the formation of an acceptable image even with extended use of the print head. Although significant progress has been made in recent years to reduce the incidence of failure of nozzles with extended use, individual nozzles sometimes fail during the course of extended use, usually because the electrical firing pulse cannot reach the nozzle or because air bubbles starve the nozzle of colorant. If a particular nozzle fails, it can no longer print a dot. In the prior approach, when a single nozzle failed, no dot could be printed at all from that nozzle, and there resulted a pronounced banding appearance in the image. If a color image was being printed, then the color of the dot printed by the failed nozzle would be incorrect, if the dot was to be a secondary color, or there would be no dot at all, if the dot were to be a primary color.

By contrast, in the process of the present invention, if an individual nozzle fails, the dot to be printed by that nozzle will still be printed because the second nozzle assigned to deposit a droplet at the selected location normally continues to operate. There is still some reduction in quality of the resulting dot, and the image quality, that can be observed on close inspection, but that reduction is not nearly so great as where the dot is not printed at all. Thus, the present approach permits the print head to be used longer, albeit at a reduced quality level. Alternatively, the user can complete a job and then replace the print head in a more leisurely manner than possible where a dot was no longer printed at all.

In the second aspect of the invention, the same colors of various dots in a pixel row are printed using different nozzles, reducing the impact of failure of any one nozzle. In accordance with this aspect of the invention, a process for depositing dots of colorant of a single selected color onto a printing medium at those pixel locations of a pixel row requiring the selected color in a predetermined color scheme, comprises the steps of furnishing at least two colorant delivery nozzles for depositing colorant of a selected color; and depositing at least two sets of droplets of colorant onto a subset of pixel locations of the pixel row, each set being deposited by one of the colorant delivery nozzles, each subset of locations being selected such that one droplet from each of the colorant nozzles is deposited therein.

More specifically, a process for depositing dots of colorant of a selected color on a printing medium on pixel locations of a pixel row according to a predetermined color scheme comprises the steps of furnishing at least two colorant delivery nozzles for depositing colorant of a selected color including a first colorant delivery nozzle and a second colorant delivery nozzle, the nozzles being supported so that they can move across and parallel to the surface of the printing medium above the pixel locations of the pixel row; depositing a first set of droplets of colorant onto a first subset of pixels of the pixel locations of the pixel row, from the first colorant delivery nozzle; and depositing a second set of droplets of colorant of the same color onto a second subset of the pixel locations of the pixel row, from the second colorant delivery nozzle.

This approach is particularly advantageous in printing color images. To produce secondary colors in a color image, droplets of two primary colors are deposited one over the other. If both droplets are doubled by printing two droplets from different nozzles, as in the approach previously described, a total of four droplets is deposited at each pixel location. The result may be too much liquid deposited for the printing medium to absorb, particularly if the printing medium is uncoated paper or an acrylate transparency.

The second embodiment of the invention therefore prints various dots in a pixel row with different combinations of nozzles, so that failure of any one nozzle has a reduced impact on image quality. As will be demonstrated, using the present approach the image quality of a print head having all nozzles operable is substantially unchanged from the conventional approach, but the image quality produced by a print head having one or more partially or fully inoperable nozzles is significantly improved as compared with the conventional approach.

The present approach thus achieves improved image quality by improving the quality and coverage of individual dots in the image, where all nozzles are operating properly. In the case where some small number of nozzles have failed, printing is still possible because each dot continues to be printed. Other features and advantages of the invention will be apparent from the following more detailed description of the preferred embodiment, taken in conjunction with the accompanying drawing, which illustrates, by way of example, the principles of the invention.

DETAILED DESCRIPTION OF THE PREFERRED EMBODIMENT

Figure 1:
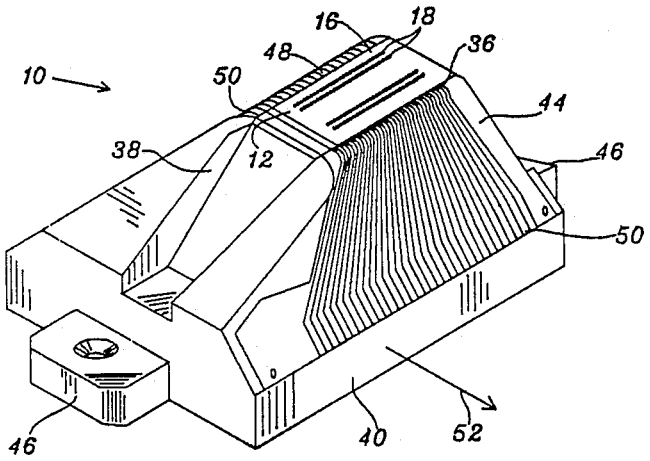
FIG. 1 is a perspective view of a thermal ink jet print head assembly.
Figure 2:
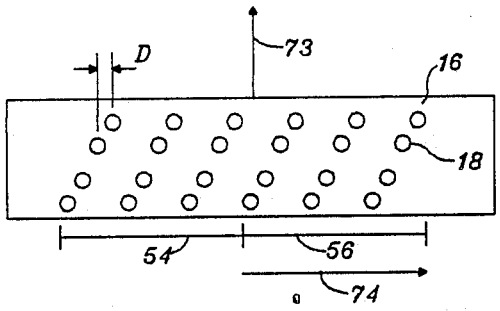
FIG. 2 is a plan view of the nozzle plate of the print head assembly.
Figure 3:
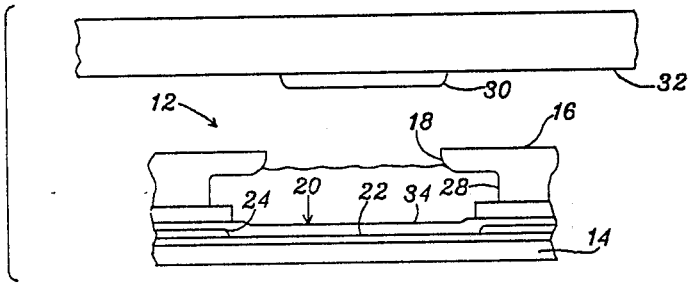
FIG. 3 is a schematic side view of an ejector.

The process of the present invention is preferably used in conjunction with a thermal ink jet printer, although it is not so restricted. A thermal ink jet print head assembly 10, used to eject droplets of ink toward a print medium in a precisely controlled manner, is illustrated in FIGS. 1–3. Such a print head assembly is discussed in more detail in U.S. Pat. No. 4,635,073, whose disclosure is incorporated by reference.

The print head assembly 10 includes an ejector 12 having a silicon substrate 14 and a nozzle plate 16. The nozzle plate 16 has a plurality of nozzles 18 therein. Droplets of colorant are ejected from the individual nozzles 18. (As used herein, the term "colorant" includes generally a fluid that is deposited upon a printing medium to produce images, such as inks or dyes, and is not restricted to any narrow sense of that term.)

Referring to FIG. 3, droplets of ink are ejected through the nozzles 18 by localized heating of the silicon substrate 14 with a heater 20. To effect such heating, the silicon substrate 14 has deposited thereon a plurality of tantalum-aluminum alloy planar resistors 22 with gold leads 24, one of the resistors being located adjacent each nozzle 18. An electrical current is passed through the portion of the resistor 22 between the ends of the leads 24, rapidly heating the resistor. A small volume of ink adjacent the resistor 22 is thereby rapidly heated and vaporized, causing some of the ink 26 in a reservoir 28 to be ejected through the nozzle 18 to be deposited as a dot 30 on a printing medium 32 (such as paper or polyester). An optional passivation layer 34 overlies the resistor 22, to protect it from corrosion by the ink.

Returning to FIG. 1, the ejector 12 is mounted in a recess 36 in the top of a central raised portion 38 of a plastic or metal manifold 40. The raised portion has slanted side walls 42, and end tabs 44 which facilitate its handling and attachment to a carriage mechanism in the printer, which will be discussed in conjunction with FIG. 4.

Electrical connection to the leads 24 and thence to the resistors 22 is supplied through bonding locations 48 on the silicon substrate 14, using a flexible interconnect circuit 50, also sometimes known as a TABcircuit. The circuit 50 fits against the side walls 44, with one end extending to the bonding locations 48 and the other end to external connections to the controllable current source that supplies current to the resistors 22. The general features, structure, and use of such flexible interconnect circuits 50, and their fabrication, are described in U.S. Pat. No. 3,689,991, whose disclosure is incorporated by reference.

FIG. 2 shows the pattern of nozzles 18 in the nozzle plate 16. In this illustration, only 24 nozzles 18 are shown so that the figure is not unnecessarily crowded. Larger numbers of nozzles in a nozzle plate are possible, and the principles of the present invention are applicable to such nozzle plates. In FIG. 2, the nozzles 18 are in a generally linear array from left to right, but staggered so that the nozzles 18 may readily fit within the available area of the nozzle plate 16. The print head 10 is mounted on a carriage in the printer so that its direction of motion is perpendicular to the linear array, in a direction indicated by arrow 52. The dots 30 may be spaced as closely as the distance D in FIG. 2 in the direction along the linear array, which is typically about 0.0033 inches, and as closely as the mechanics and electronics of deposition permit in the direction parallel to arrow 52. Increasing the number of nozzles 18 and decreasing the distance D permits very high resolution images to be formed using a pattern of dots.

Figure 4:
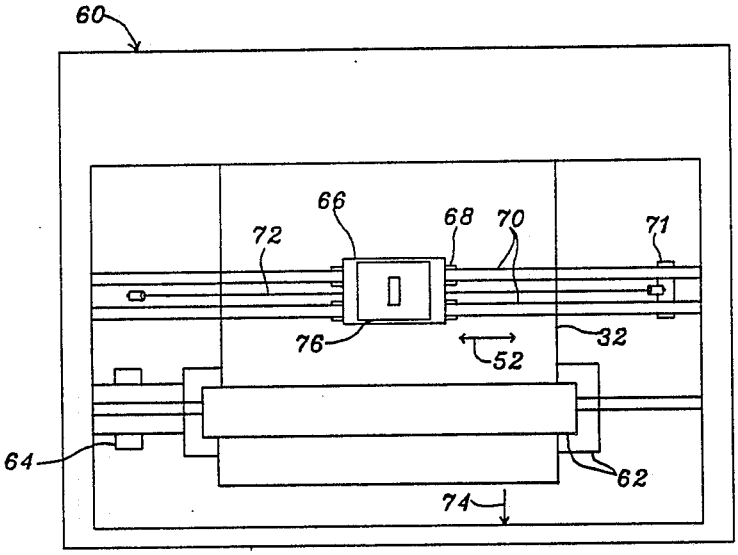
FIG. 4 is a plan view of a printer using a print head assembly.

FIG. 4 illustrates an ink jet printer 60, which can utilize print heads of the type just discussed. The printer 60 includes a pair of platens 62 between which a sheet of the printing medium 32 is supported. The platen 62 is rotatably driven by a stepping motor 64 that causes it to controllably rotate in either direction. Rotation of the platen 62 advances the printing medium in the selected direction, here indicated by the arrow 74.

A carriage 66 is supported above the sheet of printing medium 32 on bearings 68 from a pair of rails 70. The carriage 66 slides along the rails 70 under the control of a traversing motor 71 acting through a belt 72 that extends from the motor to the carriage 66. The direction of movement of the carriage 66 along the rail 70 is termed the "traversing direction", indicated by numeral 52. The traversing direction 52 is perpendicular to the direction of the advance of the printing medium 32 through rotation of the platen 62, termed the "paper advance direction" and indicated by numeral 74.

One or more of the print heads 10 is supported in the carriage 66 in a print head support 76 (one print head being illustrated in FIG. 4), in a generally facing but spaced apart relationship to the printing medium 32, so that colorant droplets ejected from the ejector 12 strike the printing medium. If the printer is only for printing of single colors, then only one print head is required. The print head produces colorant droplets, which deposit upon the printing medium 32 as the dots 30. Multiple print heads are needed where a variety of colors are to be printed. In one common practice, four print heads are supported in the carriage 66. However, the possible colors are not restricted to those four primary colors. The superposition of droplets of colorant can produce intermediate or secondary colors according to well established principles of color formation in reflection or transmission.

The dots 30 are deposited upon the printing medium 32 to form patterns that are recognizable by the human eye, in much the same manner as screened photographs in newspapers are printed. The dot sizes are typically very small, on the order of a few thousandths of an inch in diameter, so that many dots printed closely together appear to the eye to form continuous images.

Figure 5:
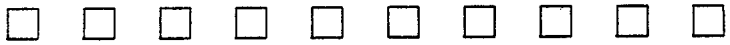
FIG. 5 is a representation of a row of pixel locations.

The electronic control of the printer 60 determines the pattern of dots to be deposited from the image to be printed. The image is divided into a raster pattern of pixels, which are assigned various intensity levels or colors. These assigned values are loaded into the print head control, which causes the proper nozzle to eject colorant at the proper moment as the carriage traverses across the printing medium 32. A convenient way to think of the development of the image is in terms of an assembly of rows of pixel locations, as illustrated in FIG. 5. In this Figure (as well as FIGS. 6–13), a row of pixel locations is indicated by a row of horizontal squares, each square being a pixel. Normally, the number of pixels is 300 per inch or more, but a smaller number of widely spaced pixels are shown for illustrative purposes. Also, the pixels are normally placed immediately adjacent each other, but in the illustrations of FIGS. 5–13 there is a spacing between pixels for clarity of illustration.

Figure 6:
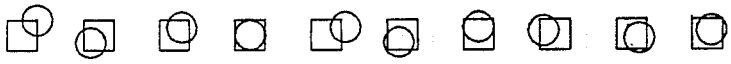
FIG. 6 is a representation of dots of a single color deposited upon a row of pixel locations from a single nozzle.

FIG. 6 illustrates the printing of a row of pixels of a single color (as in black printing) using the conventional practice. As one of the nozzles 18 of FIG. 2 passes along the row, it ejects droplets of colorant at the appropriate times based upon the content of the image. Not all of the droplets strike the exact center of the pixel, and some of the dots are therefore slightly displaced so that the pixel is not fully covered. A white unprinted area is therefore present in the image over that portion of the printed pixel which is not covered. (In FIGS. 6–13, the printed dots are shown as circles having diameters of about the side of the square. There therefore appears to be a large amount of unprinted space between pixels. In reality, the pixels are immediately adjacent and the dots are slightly larger than the pixels, so that full coverage is achieved. The present approach to depicting spaced apart dots and pixels was chosen to permit clear illustration of the principles involved.)

Figure 7:
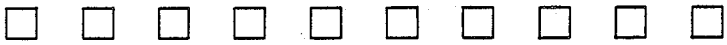
FIG. 7 is a view of the row of pixel locations of FIG. 6, when the one nozzle is inoperable.

If the particular nozzle that is printing the pixel row illustrated in FIG. 6 becomes clogged, choked by an air bubble, or otherwise inoperative or impaired in operation, none of the dots will be printed on the pixels, as illustrated in FIG. 7. The result is that the entire row is blank, and appears in the image as a white line horizontally across the image.

Figure 8:
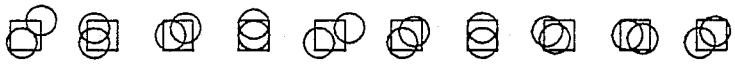
FIG. 8 is a representation of dots of a single color deposited upon a row of pixel locations from two nozzles.

One aspect of the present approach, most preferred for printing single color images such as black characters or black/grey images, is illustrated in FIG. 8. Two dots are deposited on each pixel location, each droplet being ejected from a different nozzle. It is expected that each dot will be displaced somewhat from perfect coverage of the pixel, in the manner shown in FIG. 6, but since two different nozzles are employed, the variations of coverage for the two dots are expected to vary in a statistical manner. As shown for the various pixels in the row of FIG. 8, the result is better coverage of each pixel location than in the prior approach. There are fewer white areas within the pixels using the present approach. This improvement to the image quality is present in new as well as old print heads that have been in operation for some time.

Figure 9:
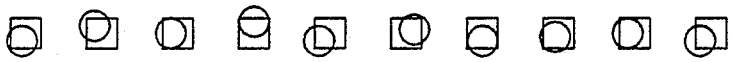
FIG. 9 is a view of the row of pixel locations of FIG. 8, when one of the two nozzles is inoperable.

The more significant advantage of the present approach occurs in print heads that have been in operation for a period of time, where one or a few nozzles become partially or wholly inoperative. In the prior approach, such condition results in horizontal white lines, as discussed in relation to FIG. 7. In the present approach, as illustrated in FIG. 9, one set of dots is still present even if one of the two nozzles fails. Since the odds of failure of both nozzles depositing dots on a pixel row is small, it is likely that one set of the dots will be printed. The quality of the pixel coverage of that row will be reduced, as may be seen by comparing the pixel row of FIG. 9 with that of FIG. 8. The image degradation is small, and there is no horizontal white line of the type of FIG. 7.

Thus, the DDA (double dot always) embodiment of the present invention yields important benefits in both the initial quality of the image, and the quality after nozzle operation becomes impaired during the life of the print head.

It is preferable that the two droplets that form each dot be deposited on successive passes of the print head 10, permitting the first deposited droplet to dry before the second droplet is deposited overlying the first droplet. The successive passes can be performed with two different print heads, but a preferred approach is to use a single print head, such as that illustrated in FIGS. 1–3, with the nozzles divided into two groups, as illustrated in FIG. 2.

To accomplish the deposition of two droplets on successive passes by the same print head, using the nozzles divided into two groups 54 and 56. The print head first passes across the face of the printing medium in the direction 52, with droplets being deposited onto the printing medium in the required pattern by a first group of nozzles 54 (the 12 nozzles on the left of FIG. 2). After the first pass is complete, the printing medium is moved in an amount and direction indicated by the arrow 74, so that the strip of printing medium previously lying under the first group of nozzles 54 now lies under a second group of nozzles 56 (the 12 nozzles on the right of FIG. 2).

The print head then traverses across the printing medium in a second pass in the direction 52 with the second group of nozzles 56 depositing droplets of ink in exactly the same pattern during the second pass as did the first group of nozzles 54 in the first pass. The array of nozzles in the second group 56 is identical to that of the first group 54, and therefore the droplets deposited by the second group of nozzles 54 overlie the droplets deposited by the first group of nozzles 52. The output of the printer can be increased by printing the second group of droplets with the print head moving in the opposite direction to that of the arrow 52, so that both droplets for each dot are printed in a single traverse and return to the original position of the print head.

As the second set of droplets for each dot is printed by the second group of nozzles 56, the first group of nozzles 54 deposits the first set of droplets for the next printed swath of the pattern. That is, the all of the nozzles of the print head are available for operation during each pass. Control of the printing is accomplished using the printer buffer available in printers to control the prior approach. The print head operates in conjunction with the printer buffer. The locations to be printed in a pass are calculated by the known printing algorithm, which decomposes each swath of the image into a pattern of dots. The present approach determines the locations of the dots to be printed for the first swath, which are printed in the first pass by the first group 54 of nozzles. After the first pass is completed, the locations from the print buffer printed by the first group of nozzles 54 in the first pass are then moved to the appropriate buffer locations to control the deposition of the droplets by the second group 56 of nozzles in the second pass, resulting in the previously described overprinting of each dot a second time during the second pass. At the same time, a new swath of locations to be printed is loaded into the portion of the buffer controlling the first group 54 of nozzles and printed in the second pass, and these locations are printed while the second group 56 of nozzles are depositing droplets on the previously printed group of dots.

The principles just discussed can be extended to more than two droplets per dot, from the same number of different nozzles as there are droplets. The use of four droplets per dot, from four different nozzles, is found particularly useful for printing on transparent polyester.

The principles of the invention are also applicable to the printing of color images. In most color ink jet printers, color images are formed by providing four print heads (or dedicated sections of one or two print heads), each one depositing a different primary color. Secondary colors are formed by depositing droplets of two primary colors over each other. The usual primary colors provided in the printer are yellow, black, cyan, and magenta. Red is printed as the superposition of yellow and magenta droplets, green is printed as the superposition of yellow and cyan droplets, and blue is printed as the superposition of magenta and cyan droplets.

One approach to improving image quality according to the invention is printing two droplets of each color, from two different nozzles, for each of the two primary colors required for a pixel location of a secondary color. Two droplets of the same color, from different nozzles, are printed for each primary color. This approach yields improved coverage of the pixel locations for the reasons discussed earlier. It may also result in distortions in color due to multiple superposition of dots, and can also cause cockle of the paper and running of the droplets because the printing medium cannot absorb the liquid deposited from four droplets at each secondary pixel location. For these reasons, this approach is not preferred.

A more preferred approach to improved color image quality is illustrated in FIGS. 10–13. In these figures, each secondary color is formed by two droplets even under conventional approaches, but these two droplets are of different colors. It is assumed for simplicity that the same secondary colors are formed in each case, but that one of the two pixels labelled as primary colors is one of the primary colors used to form the secondary color and that the other primary colored pixel is of the other primary color used to form the secondary color. Thus, in the prior approach illustrated in FIG. 10, two dots are present on each secondary color pixel, and one dot is present on each primary color pixel.

In FIGS. 10–13, each pixel is labelled in two ways. First, it is labelled as being a secondary color S or a primary color P, because the images cannot be printed in color. Second, each pixel is labelled as to whether it is the correct color "OK", a distorted color "D", or an uncolored pixel "X". These latter indications become significant in assessing images degraded due to inoperative or partially operative nozzles.

Figure 10:
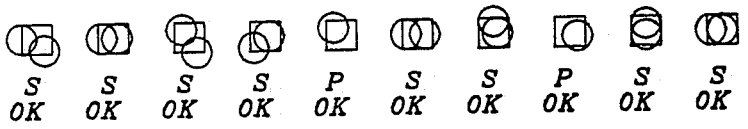
FIG. 10 is a representation of dots of a secondary color deposited upon a row of pixel locations, with each primary color from a single nozzle.
Figure 11:
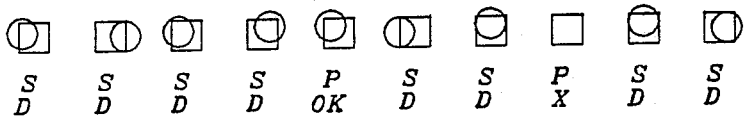
FIG. 11 is a view of the row of pixel locations of FIG. 10, when one of the color nozzles is inoperable.

FIG. 10 illustrates the formation of primary and secondary colors under the prior approach. One primary color dot is present on each P pixel, and two primary color dots are present on each S pixel. If one of the nozzles producing the primary colors becomes inoperable, the result is shown in FIG. 11. All of the S pixels have a distorted color, because only one of the primary colors is deposited thereupon. One of the P pixels is acceptable, and the other has no dot printed on it and is uncolored. This image is highly degraded, because only one of the original pixels has the correct color, most of the other pixels have distorted colors, and one of the pixels has no color at all.

Figure 12:
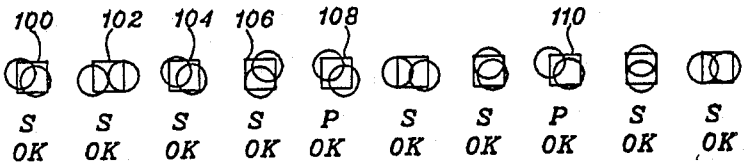
FIG. 12 is a representation of dots of a secondary color deposited upon a row of pixel locations, with each primary color from a single nozzle but with alternating pixels produced with different nozzles, and primary colors produced with two dots from different nozzles.

In accordance with the preferred embodiment of the invention as applied to color printing, different pixels in a row are printed using colors ejected from different nozzles. This approach is illustrated in FIG. 12, where there are primary color pixels C1 and C2, and secondary color pixels formed by superimposing dots of C1 and C2. There are available two nozzles for each color, for color C1 the nozzles N1(C1) and N2(C2) and for color C2 the nozzles N1(C2) and N2(C2).

Referring to FIG. 12, the first pixel in a row, the S pixel 100, is printed by two dots of different colors C1 and C2, the color C1 being ejected by nozzle N1(C1) and the other color C2 being ejected by nozzle N1(C2). The second pixel in the row, the S pixel 102, is printed by two dots of different colors C1 and C2 (the same colors as printed onto pixel 100), but from different nozzles N2(C1) and N2(C2), respectively. The third S pixel 104 is printed by the same two nozzles that printed the first pixel 100, N1(C1) and N1(C2). The fourth X pixel 106 is printed by the same two nozzles that printed the second pixel 102, N2(C1) and N2(C2).

The fifth pixel in the illustrated example is a primary color pixel, here assumed to be the primary color C1. It is printed with two dots produced by the two nozzles that deposit the C1 color, N1(C1) and N2(C1).

The pattern of alternating nozzles printing the secondary color pixels then continues. The other primary color pixel 110, which is assumed to be the C2 color, is printed using the two nozzles that print the C2 color, N1(C2) and N2(C2).

As shown in FIG. 12, all of the pixels are the correct color. Additionally, the primary color pixels 108 and 110 have two dots of the same color on the pixel, rather than one dot as in the prior approach.

Figure 13:
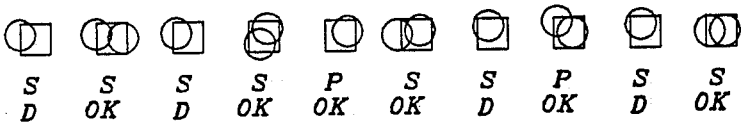
FIG. 13 is a view of the row of pixel locations of FIG. 12, when one of the color nozzles is inoperable.

FIG. 13 illustrates the resulting color arrangement in the event that one of the nozzles fails, here assumed to be N1(C1). The color of pixel 100 is distorted, that of pixel 102 is correct, that of pixel 104 is distorted, and that of pixel 106 is correct. The color of the primary color pixel 108 is correct, even though one of the nozzles depositing on that pixel failed. The succeeding secondary color pixels have the repeating pattern of correct and distorted color. The primary pixel 110 has the correct color, as neither of the nozzles contributing to its color failed.

The appearance of the pixel row using the present approach, FIG. 13, may be contrasted with that using the prior approach, FIG. 11. In FIG. 13, all of the primary pixels are printed and have the correct color. Half of the secondary pixels have the correct color, and have have a distorted color. None of the pixels are unprinted. The appearance of the row is therefore much less degraded by the failure of a single nozzle than is the appearance of the row in FIG. 11, also degraded by failure of a single nozzle. FIGS. 10–13 are, of course, exemplary of a pixel row, and their specific appearance reflects the assumptions discussed above. However, it is generally true that the adoption of the approach wherein different nozzles are used in printing various pixel locations of the row generally yields an image that is resistant to degradation after failure of isolated nozzles of the print head. And, significantly, the improvement is achieved with only two droplets of colorant deposited at each pixel location, which can be readily absorbed by typical printing media.

The use of multiple nozzles for each color of a row is not restricted to two nozzles, but is applicable for three or more nozzles ejecting colorant of the same color, for each pixel row. However, the computational procedures are more complex, and the printing time for each page of the printing medium is slower. The use of two nozzles for each color of the row is therefore preferred.

Printing of the row of pixels with primary and secondary colors is by the approach discussed earlier for single color printing, except that multiple print heads of a single color each, or multiple clusters of nozzles of a single color in a single print head, are used.

The approach of the present invention results in better image quality, both initially and as nozzles may fail during extended use. Both color and black-and-white images may be printed with the double dot technique. Although a particular embodiment of the invention has been described in detail for purposes of illustration, various modifications may be made without departing from the spirit and scope of the invention. Accordingly, the invention is not to be limited except as by the appended claims.

What is claimed is:

1. A process for depositing two dots of a single colorant onto a printing medium at a single selected pixel location, comprising the steps of:

furnishing two colorant delivery nozzles that each deposit colorant of the same selected color, including a first colorant delivery nozzle and a second colorant delivery nozzle, the two nozzles being located on a traversing mechanism that traverses across the printing medium parallel to its surface;

depositing a first droplet of colorant onto the printing medium at the selected pixel location, from the first colorant delivery nozzle; and depositing a second droplet of colorant of the same color onto the printing medium at the same selected pixel location, from the second colorant delivery nozzle, the step of depositing a second droplet being accomplished on a different traverse across the printing medium than the step of depositing a first droplet.

2. The process of claim 1, wherein the colorant is deposited by thermally ejecting droplets from the nozzles.

3. A process for depositing dots of colorant of a single color onto a printing medium in a selected pattern of pixel locations, comprising the steps of:

furnishing at least two sets of colorant delivery nozzles that all deposit colorant of the same selected color, including a first set of colorant delivery nozzles and a second set of colorant delivery nozzles;

depositing a first set of droplets of colorant onto the printing medium in the selected pattern of pixel locations, from the first set of colorant delivery nozzles; and depositing a second set of droplets of colorant of the same color onto the printing medium in the same selected pattern of pixel locations, from the second colorant delivery nozzle.

4. the process of claim 3, wherein the colorant is deposited by thermally ejecting droplets from the nozzles.

5. The process of claim 3, wherein the nozzles are mounted on a traversing mechanism that moves above the surface of the printing medium.

6. The process of claim 5, wherein the step of depositing a second set of droplets is accomplished on the same traverse across the printing medium as the step of depositing a first set of droplets.

7. The process of claim 5, wherein the step of depositing a second set of droplets is accomplished on a different traverse across the printing medium as the step of depositing a first set of droplets.

8. A process for depositing dots of colorant onto a printing medium in a selected pattern of pixel locations, comprising the steps of:

furnishing a print head having at least two colorant delivery nozzles for depositing colorant of the same selected color, including a first colorant delivery nozzle and a second colorant delivery nozzle, the print head being mounted on a traversing mechanism that moves the print head parallel to and across the surface of a printing medium;

traversing the print head over the printing medium in a first pass;

depositing a first set of droplets of colorant onto the printing medium in the selected pattern of pixel locations during the first pass, from the first colorant delivery nozzle;

traversing the print head across the printing medium in a second pass; and depositing a second set of droplets of colorant onto the printing medium in the same selected pattern of pixel locations during the second pass, from the second colorant delivery nozzle.

9. The process of claim 8, wherein the colorant jet print head is a thermal colorant jet print head.

10. A process for depositing dots of colorant of a single selected color onto a printing medium at those pixel locations of a pixel row requiring the selected color in a predetermined color scheme, comprising the steps of:

furnishing at least two colorant delivery nozzles for depositing colorant of a selected color; and depositing at least two sets of droplets of colorant onto a subset of pixel locations of the pixel row, each set of droplets of colorant being deposited by one of the colorant delivery nozzles, and each subset of locations being selected such that one droplet from each of the colorant nozzles is deposited therein.

11. The process of claim 10, wherein the colorant is deposited by thermally ejecting droplets from the nozzles.

12. The process of claim 10, wherein the nozzles are mounted on a traversing mechanism that traverses across the printing medium parallel to its surface and parallel to the pixel row.

13. A process for depositing dots of colorant of a selected color on a printing medium on pixel locations of a pixel row according to a predetermined color scheme, comprising the steps of:

furnishing at least two colorant delivery nozzles for depositing colorant of a selected color including a first colorant delivery nozzle and a second colorant delivery nozzle, the nozzles being supported so that they can move across and parallel to the surface of the printing medium above the pixel locations of the pixel row;

depositing a first set of droplets of colorant onto a first subset of pixels of the pixel locations of the pixel row, from the first colorant delivery nozzle; and depositing a second set of droplets of colorant of the same color onto a second subset of the pixel locations of the pixel row, from the second colorant delivery nozzle.

14. The process of claim 13, wherein the first subset of pixel locations is the same as the second subset of pixel locations.

15. The process of claim 13, wherein the first subset of pixel locations and the second subset of pixel locations are not the same, but the two subsets together include all pixel locations of the row that require a droplet of the selected color according to the predetermined color scheme.

16. The process of claim 13, wherein the colorant is deposited by thermally ejecting droplets from the nozzles.

* * * * *

US004963882B1

REEXAMINATION CERTIFICATE (3037th)

United States Patent [19]

Hickman

[11] B1 4,963,882

[45] Certificate Issued Oct. 29, 1996

[54] PRINTING OF PIXEL LOCATIONS BY AN INK JET PRINTER USING MULTIPLE NOZZLES FOR EACH PIXEL OR PIXEL ROW

[75] Inventor: Mark S. Hickman, Escondido, Calif.

[73] Assignee: Hewlett-Packard Company, Palo Alto, Calif.

Reexamination Request:
No. 90/003,768, Mar. 24, 1995

Reexamination Certificate for:

| | |
|---|---|
| Patent No.: | **4,963,882** |
| Issued: | **Oct. 16, 1990** |
| Appl. No.: | **290,543** |
| Filed: | **Dec. 27, 1988** |

[51] Int. Cl.[6] ..... B41J 2/01; B41J 2/05

[52] U.S. Cl. ..... 347/41; 347/43

[58] Field of Search ..... 347/43, 41, 40, 347/15, 9, 5; 400/124.07, 124.08

[56] References Cited

U.S. PATENT DOCUMENTS

| | | | |
|---|---|---|---|
| 4,272,771 | 6/1981 | Furukawa | 347/41 X |
| 4,320,406 | 3/1982 | Heinzl | 347/43 |
| 4,596,990 | 6/1986 | Hou | 347/41 |
| 4,622,560 | 11/1986 | Withoos et al. | 347/41 X |
| 4,635,073 | 1/1987 | Hanson | 347/50 |
| 4,686,538 | 8/1987 | Kouzato | 347/15 |
| 4,721,968 | 1/1988 | Arai | 347/105 X |
| 4,788,563 | 11/1988 | Omo | 347/101 X |
| 4,809,016 | 2/1989 | Padalino | 347/41 |
| 4,943,813 | 7/1990 | Palmer | 347/41 |

FOREIGN PATENT DOCUMENTS

| | | | |
|---|---|---|---|
| 354113217 | 9/1979 | Japan | G06K 15/10 |
| 358173671 | 10/1983 | Japan | B41J 3/04 |
| 358194541 | 11/1983 | Japan | B41J 3/00 |
| 361123545 | 6/1986 | Japan | B41J 3/10 |

*Primary Examiner*—Joseph W. Hartary

[57] ABSTRACT

An ink jet printer (60) prints dots (30) of colorant at pixel locations using a printing strategy that reduces the visual impact of improperly operating or inoperable nozzles (18), by using multiple nozzles (18) per pixel location or per pixel row. In one approach, used either for single color or multicolor images, multiple droplets of colorant of the same color are deposited upon a single pixel location from two different nozzles (10). (In another approach, used primarily for multicolor images, different pixels of a single pixel row are printed using droplets of a single color from different nozzles (18).

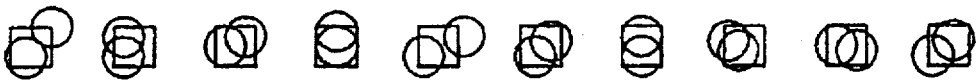

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 7, lines 10–28:

FIG. 2 shows the pattern of nozzles 18 in the nozzle plate 16. In this illustration, only 24 nozzles 18 are shown so that the figure is not unnecessarily crowded. Larger numbers of nozzles in a nozzle plate are possible, and the principles of the present invention are applicable to such nozzle plates. in FIG. 2, the nozzles 18 are in a generally linear array from left to right, but staggered so that the nozzles 18 may readily fit within the available area of the nozzle plate 16. The print head 10 is mounted on a carriage in the printer so that its direction of motion is perpendicular to the linear array, in a *motion* direction indicated by arrow [52] *73* (*and by arrow 52 in FIG. 1*). The dots 30 may be spaced as closely as the distance D in FIG. 2 in the direction along the linear array, which is typically about 0.0033 inches, and as closely as the mechanics and electronics of deposition permit in the direction parallel to arrow [52] *73*. Increasing the number of nozzles 18 and decreasing the distance D permits very high resolution images to be formed using a pattern of dots.

AS A RESULT OF REEXAMINATION, IT HAS BEEN DETERMINED THAT:

Claims 1, 3, 8, 10 and 13 are determined to be patentable as amended.

Claims 2, 4–7, 9, 11, 12 and 14–16, dependent on an amended claim, are determined to be patentable.

New claims 17–23 are added and determined to be patentable.

1. A process for depositing two dots of a single colorant onto a printing medium at a single selected pixel location, comprising the steps of:

furnishing *a print head including* two colorant delivery nozzles that each deposit colorant of the same selected color, including a first colorant delivery nozzle and a second colorant delivery nozzle, the [two nozzles] *print head* being located on a traversing mechanism that traverses across the printing medium parallel to its surface;

depositing a first droplet of colorant onto the printing medium at the selected pixel location, from the first colorant delivery nozzle; and depositing a second droplet of colorant of the same color onto the printing medium at the same selected pixel location, from the second colorant delivery nozzle, the step of depositing a second droplet being accomplished on a different traverse across the printing medium than the step of depositing a first droplet.

3. A process for depositing dots of colorant of a single color onto a printing medium in a selected pattern of pixel locations *of two or more adjacent pixel rows*, comprising the steps of:

furnishing *a print head including* at least two [sets] *groups* of colorant delivery nozzles that all deposit colorant of the same selected color, including a first [set] *group* of colorant delivery nozzles and a second [set] *group* of colorant delivery nozzles *each of the first and second groups of colorant delivery nozzles including two or more nozzles and the nozzles in the first and second groups of colorant delivery nozzles being offset from each other such that no two nozzles are aligned along any line parallel to a traverse direction*;

*traversing the print head in the traverse direction over the printing medium in a first pass;* depositing *on the first pass* a first set of droplets of colorant onto the printing medium in the selected pattern of pixel locations, from the first [set] *group* of colorant delivery nozzles;

*traversing the print head in the traverse direction over the printing medium in a second pass;* and depositing *on the second pass* a second set of droplets of colorant of the same color onto the printing medium in the same selected pattern of pixel locations, from the second *group of* colorant delivery [nozzle] *nozzles, each set of droplets deposited such that at least one droplet from each set of droplets is deposited on each pixel row of the selected pattern.*

8. A process for depositing dots of colorant onto a printing medium in a selected pattern of pixel locations *of two or more adjacent pixel rows*, comprising the steps of:

furnishing a print head having at least two *groups of* colorant delivery nozzles for depositing colorant of the same selected color, including a first *group of* colorant delivery [nozzle] *nozzles* and a second *group of* colorant delivery [nozzle] *nozzles*, the print head being mounted on a traversing mechanism that moves the print head parallel to and across the surface of a printing medium *in a traverse direction, the nozzles in the first and second groups of colorant delivery nozzles being offset from each other such that no two nozzles are aligned along any line parallel to the traverse direction*;

traversing the print head over the printing medium in a first pass;

depositing a first set of droplets of colorant onto the printing medium in the selected pattern of pixel locations *of two or more adjacent pixel rows* during the first pass, from the first *group of* colorant delivery [nozzle] *nozzles*;

traversing the print head across the printing medium in a second pass; and depositing a second set of droplets of colorant onto the printing medium in the same selected pattern of pixel locations *of two or more adjacent pixel rows* during the second pass, from the second *group of* colorant delivery [nozzle] *nozzles, each set of droplets deposited such that at least one droplet from each set of droplets is deposited on each pixel row of the two or more adjacent pixel rows.*

10. A process for depositing dots of colorant of a single selected color onto a printing medium at those pixel locations of [a] *two or more adjacent* pixel [row] *rows* requiring the selected color in a predetermined color scheme, comprising the steps of:

furnishing *a print head including* at least two *groups of* colorant delivery nozzles for depositing colorant of a selected color, *the print head being located on a traversing mechanism that traverses across the printing medium parallel to its surface*; and depositing at least two sets of droplets of colorant onto [a subset] *at least two subsets* of pixel locations of the pixel [row] *rows*, each set of droplets of colorant being deposited by one of the *groups of* colorant delivery nozzles, *each set of droplets of colorant being deposited during a separate pass of the print head*, and each subset of locations being selected such that *at least* one droplet from each of the *groups of* colorant nozzles is deposited *on each pixel row* therein.

13. A process for depositing dots of colorant of a selected color on a printing medium on pixel locations of [a] *two or more adjacent* pixel [row] *rows* according to a predetermined color scheme, comprising the steps of:

furnishing *a print head including* at least two *groups of* colorant delivery nozzles for depositing colorant of a selected color including a first *group of* colorant delivery [nozzle] *nozzles* and a second *group of* colorant delivery [nozzle]*nozzles*, the *groups of* nozzles being supported so that they can [move] *traverse* across and parallel to the surface of the printing medium above the pixel locations of the *adjacent* pixel [row] *rows in a traverse direction, the nozzles in the first and second groups of colorant delivery nozzles being offset from each other such that no two nozzles are aligned along any line parallel to the traverse direction*;

*traversing the print head over the printing medium in a first pass;* depositing *during the first pass* a first set of droplets of colorant onto a first subset of pixels of the pixel locations of the pixel [row] *rows*, from the first *group of* colorant delivery [nozzle] *nozzles*; [and]

*traversing the print head over the printing medium in a second pass; and* depositing *during the second pass* a second set of droplets of colorant of the same color onto a second subset of the pixel locations of the pixel [row] *rows*, from the second *group of* colorant delivery [nozzle] *nozzles, each subset of pixels including at least one pixel location from each of the adjacent pixel rows.*

*17. The process of claim 13, wherein the first and second groups of colorant delivery nozzles are provided in a staggered linear array, the direction of the linear array being generally perpendicular to the direction of the traversing of the print head, and the spacing of the nozzles in the direction of the linear array being substantially equal to the spacing of the pixel rows.*

*18. The process of claim 17, wherein the first group of colorant delivery nozzles includes a first nozzle and a second nozzle adjacent in the direction of the linear array to the first nozzle, the second group of colorant delivery nozzles includes a third nozzle and a fourth nozzle adjacent in the direction of the linear array to the third nozzle, the two or more adjacent pixel rows includes a first pixel row and a second pixel row adjacent to the first pixel row, and wherein the step of depositing during a first pass includes depositing droplets of colorant on the first pixel row from the first nozzle and depositing droplets of colorant on the second row from the second nozzle, and the step of depositing during a second pass includes depositing droplets of colorant on the first pixel row from the third nozzle and depositing droplets of colorant on the second row from the fourth nozzle.*

*19. The process of claim 13 wherein the number of adjacent pixel rows equals the number of nozzles in the first group of colorant delivery nozzles.*

*20. The process of claim 13 further comprising the steps of:*

*traversing a third group of colorant delivery nozzles over the printing medium in a third pass; and*

*depositing during the third pass a third set of droplets of colorant onto a third subset of pixels of the pixel locations of the pixel rows, from the third group of colorant delivery nozzles.*

*21. The process of claim 20 further comprising the steps of:*

*traversing a fourth group of colorant delivery nozzles over the printing medium in a fourth pass; and*

*depositing during the fourth pass a fourth set of droplets of colorant onto a fourth subset of pixels of the pixel locations of the pixel rows, from the fourth group of colorant delivery nozzles.*

*22. The process of claim 13 wherein the first subset of pixels and the second subset of pixel locations are not fully overlapping.*

*23. The process of claim 1, wherein the first and second colorant delivery nozzles are positioned such that the first and second colorant delivery nozzles are offset from each other and are not aligned along any line parallel to a traversing direction of the traversing mechanism.*

* * * * *